US005678126A

United States Patent [19]

Rathbun

[11] Patent Number: 5,678,126

[45] Date of Patent: Oct. 14, 1997

[54] FILMING ATTENUATION CORRECTING TONER CONCENTRATION SENSOR ASSEMBLY AND METHOD

[75] Inventor: Darrel R. Rathbun, Ontario, N.Y.

[73] Assignee: Xerox Corporation, Stamford, Conn.

[21] Appl. No.: 720,521

[22] Filed: Sep. 30, 1996

[51] Int. Cl.[6] ..... G03G 21/00

[52] U.S. Cl. ..... 399/30; 118/691; 356/436

[58] Field of Search ..... 399/30, 64, 65, 399/61; 118/691; 250/575; 356/436; 430/117, 118, 119

[56] References Cited

U.S. PATENT DOCUMENTS

| | | | |
|---|---|---|---|
| 4,551,004 | 11/1985 | Paraskevopoulos | 355/3 DD |
| 4,950,905 | 8/1990 | Butler et al. | 250/358.1 |
| 4,980,727 | 12/1990 | Stelter | 355/246 |
| 4,981,362 | 1/1991 | de Jong et al. | 356/436 |
| 5,083,165 | 1/1992 | Landa | 355/256 |
| 5,119,132 | 6/1992 | Butler | 355/208 |
| 5,208,637 | 5/1993 | Landa | 355/256 |

*Primary Examiner*—Arthur T. Grimley
*Assistant Examiner*—Quana Grainger
*Attorney, Agent, or Firm*—Tallam I. Nguti

[57] ABSTRACT

A filming attenuation correcting toner concentration sensor assembly and method of controlling in a container, a concentration of a mixture that includes a light absorbing substance and a clear liquid carrier in solution, while correcting the effects of container filming. The method includes the steps of splitting light from a single light source having a controllable intensity, into a first light beam and a separate second light beam; focusing the first light beam through a first quantity of the mixture contained in a first light transmitting container made of a first material and having a first thickness, as well as focusing the second light beam through a second quantity of the mixture contained in a second light transmitting container made of the first material and having a second thickness greater than the first thickness of the first light transmitting container; generating a first proportional output signal by sensing with a first photodiode, a first attenuated light transmitted from the first light beam through the first light transmitting container and through the first quantity of the mixture; generating a second proportional output signal by sensing with a second photodiode, a second attenuated light transmitted from the second light beam through the second light transmitting container and through the second quantity of the mixture; maintaining the second proportional output signal at a constant level by adjusting the controllable intensity of the single light source; and adjusting the concentration of the light absorbing substance in the mixture such that a filming-effect independent ratio that is equal to the first proportional output signal divided by the second proportional output signal, is also maintained as a constant, thereby achieving a toner concentration of the mixed developer material that is maintained at a desired level, without the undesirable effects of filming of optical surfaces.

5 Claims, 5 Drawing Sheets

FILMING ATTENUATION CORRECTING TONER CONCENTRATION SENSOR ASSEMBLY AND METHOD

BACKGROUND OF THE INVENTION

This invention relates to liquid immersion development (LID) reproduction machines, and more particularly to a filming attenuation correcting toner concentration sensor assembly and method for use in such a machine to produce high quality developed images.

Liquid electrophotographic reproduction machines are well known, and generally each includes an image bearing member or photoreceptor having an image bearing surface on which latent images are formed and developed as single color or multiple color toner images for eventual transfer to a receiver substrate or copy sheet. Each such reproduction machine thus includes a development system or systems that each utilizes a liquid developer material typically having about 2 percent by weight of charged, solid particulate toner material of a particular color, that is dispersed at a desired concentration in a clear liquid carrier.

In the electrophotographic process of such a machine, the latent images formed on the image bearing surface of the image bearing member or photoreceptor are developed with the charged toner particles, with excess liquid carrier being left behind or removed such that the developed images typically each contain about 12 percent by weight of the toner particles. The developed image or images on the image bearing member are then further conditioned and subsequently electrostatically transferred from the image bearing surface to an intermediate transfer member. Following that, the conditioned image or images are then hot or heat transferred from the intermediate transfer member, at a heated transfer or transfix nip, to an output image receiver substrate or copy sheet.

The quality of the final output image on the receiver substrate or copy sheet depends in substantial part on the desired concentration of the charged toner particles in the liquid developer material used at the development stage. As is well known, as each latent image is developed, toner particles are depleted or removed from such liquid developer material in the system, thus changing the "toner concentration" (TC) of the liquid developer material. It is thus well known to replenish or supply fresh liquid developer to the development system, and to use a toner concentration sensor in attempts to precisely adjust and maintain the toner concentration, TC at a desired level.

Existing sensors on the market merely use a single optical path to measure attenuation of an incident light beam as the beam passes through a given thickness of liquid developer material. In such cases, the amount of attenuation is detected by a photodiode or similar device of the sensor. The sensor then generates a proportional output signal that is treated as a measure of the toner concentration of the liquid developer material. A main problem with this type of measure is lack of stability. In particular, whereas the electronic stability of the light source and of the sensor amplifier circuitry can be reasonably maintained using intensity feedback correcting techniques, and good circuitry design, the stability of the optical attenuation is not easy to control. One major problem causing such lack of optical attenuation stability is filming of the optical surfaces. One visible result of instability in optical attenuation due to filming is a gradual drift over time of sensor results from the same sample.

A conventional liquid developer material replenishment system including a conventional single optical path toner concentration or density sensor as above is each disclosed, for example, in U.S. Pat. No. 5,208,637 and 5,083,165. Similar conventional single optical path sensors are also disclosed, for example, in U.S. Pat. Nos. 5,119,132; 4,981,362; 4,950,905, and 4,551,004. In the application of each of these conventional single optical path sensors, light attenuation which is used in one form or another for controlling TC, is undesirably due not only to changes in toner concentration, (TC), but also to undesirable filming of the optical surfaces of the sensor assembly. Optical surfaces in any such application include the external surfaces of the light source, of the toner container, and of the sensor itself, but most particularly of the internal surfaces of the toner container owing to filming characteristics of the liquid developer material.

In U.S. Pat. No. 4,980,727, a variation of the conventional single optical path sensor assembly is disclosed and includes a second non-measuring sensor used merely as a reference sensor to enable control of the gain and offset of the measuring sensor amplifier circuit for toners of different reflectivities. Light attenuation in this variation is still unfortunately due not only to differences in toner reflectivities, but also to uncorrected filming of the optical surfaces.

There has therefore been a need for a filming attenuation correcting toner concentration sensor assembly and method that are particularly usable in toner development machines for producing high quality developed images on receiver copy sheets.

SUMMARY OF THE INVENTION

In accordance with the present invention, there is provided a filming attenuation correcting toner concentration sensor assembly and method of controlling in a container, a concentration of a mixture that includes a light absorbing substance and a clear liquid barrier in solution while correcting the effects of container filming. The method includes the steps of splitting light from a single light source, having a controllable intensity, into a first light beam and a separate second light beam; focusing the first light beam through a first quantity of the mixture contained in a first light transmitting container made of a first material and having a first thickness, as well as focusing the second light beam through a second quantity of the mixture contained in a second light transmitting container made of the first material and having a second thickness greater than the first thickness of the first light transmitting container; generating a first proportional output signal by sensing with a first photodiode, a first attenuated fight transmitted from the first light beam through the first light transmitting container and through the fast quantity of the mixture; generating a second proportional output signal by sensing with a second photodiode, a second attenuated light transmitted from the second light beam through the second light transmitting container and through the second quantity of the mixture; maintaining the second proportional output signal at a constant level by adjusting the controllable intensity of the single light source; and adjusting the concentration of the light absorbing substance in the mixture such that a filming-effect independent ratio that is equal to the first proportional output signal divided by the second proportional output signal, is also maintained as a constant, thereby achieving a toner concentration of the mixed liquid developer material that is maintained at a desired level, without undesirable effects of filming of optical surfaces.

BRIEF DESCRIPTION OF THE DRAWINGS

Other aspects of the present invention will become apparent as the following description proceeds and upon reference to the drawings, in which.

DETAILED DESCRIPTION OF THE INVENTION

Figure 1:
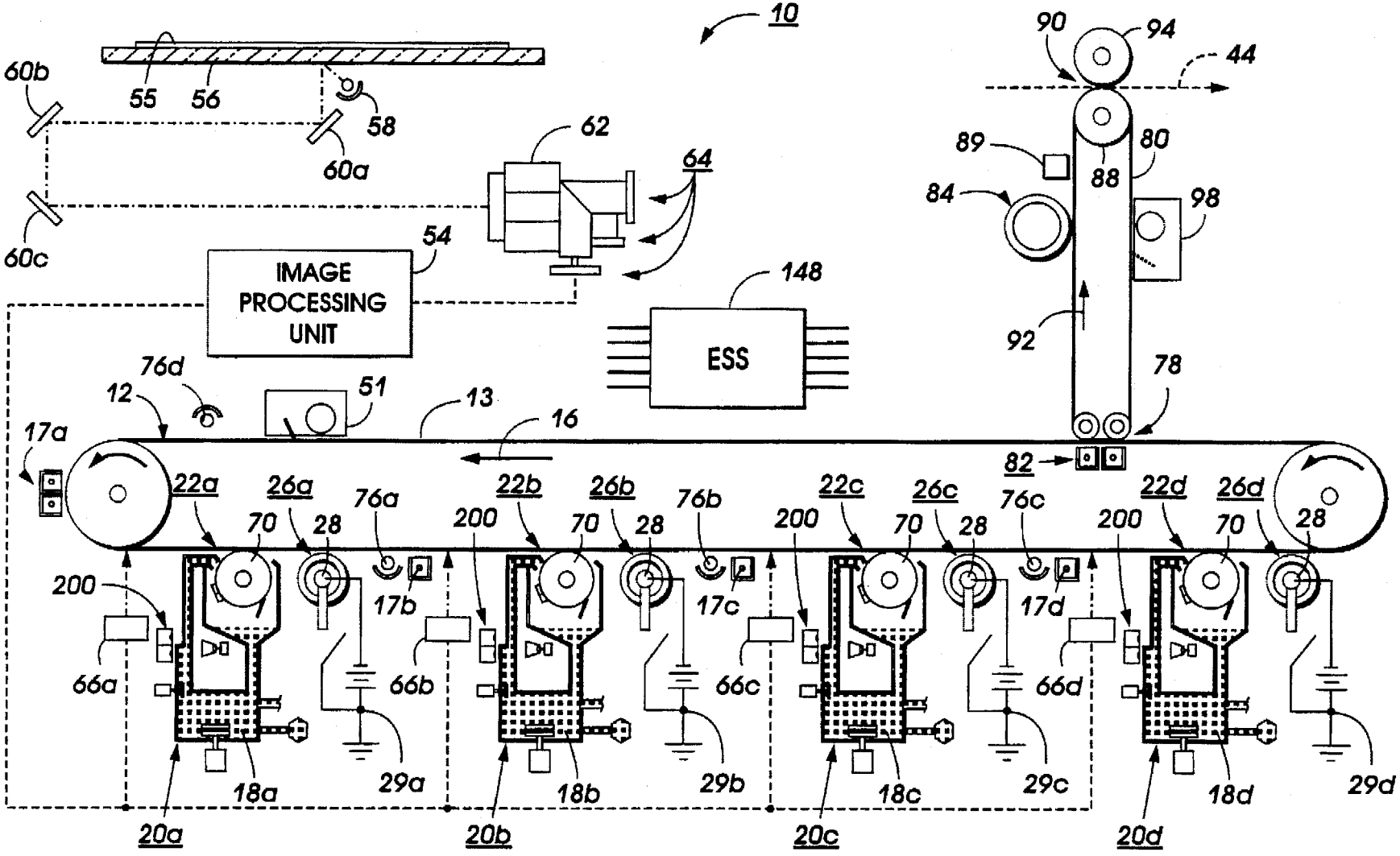
FIG. 1 is a vertical schematic of an exemplary color electrophotographic liquid immersion development (LID) reproduction machine incorporating a development system including the filming attenuation correcting toner concentration sensor assembly in accordance with the present invention.

For a general understanding of the features of the present invention, reference numerals have been used throughout to designate identical elements. It will become evident from the following discussion that the present invention is equally well suited for use in a wide variety of reproduction machines and is not necessarily limited in its application to the particular embodiment depicted herein.

Inasmuch as the art of electrophotographic reproduction is well known, the various processing stations employed in the FIGS. 1 and 2 of the reproduction machine will be shown hereinafter only schematically, and their operation described only briefly.

Referring now to FIG. 1, there is shown a color electrophotographic reproduction machine 10 incorporating a development system including the filming attenuation correcting toner concentration sensor assembly of the present invention. Although a multiple color LID machine is illustrated, it is understood that the invention is equally suitable for a single color LID machine. The color copy process of the machine 10 can begin by either inputting a computer generated color image into an image processing unit 54 or by way of example, placing a color document 55 to be copied on the surface of a transparent platen 56. A scanning assembly consisting of a halogen or tungsten lamp 58 which is used as a light source, and the light from it is exposed onto the color document 55. The light reflected from the color document 55 is reflected, for example, by a 1st, 2nd, and 3rd mirrors 60*a*, 60*b* and 60*c*, respectively through a set of lenses (not shown) and through a dichroic prism 62 to three charged-coupled devices (CCDs) 64 where the information is read. The reflected light is separated into the three primary colors by the dichroic prism 62 and the CCDs 64. Each CCD 64 outputs an analog voltage which is proportional to the intensity of the incident light. The analog signal from each CCD 64 is converted into an 8-bit digital signal for each pixel (picture element) by an analog/digital converter (not shown). Each digital signal enters an image processing unit 54. The digital signals which represent the blue, green, and red density signals are converted in the image processing unit 54 into four bitmaps: yellow (Y), cyan (C), magenta (M), and black (Bk). The bitmap represents the value of exposure for each pixel, the color components as well as the color separation. Image processing unit 54 may contain a shading correction unit, an undercolor removal unit (UCR), a masking unit, a dithering unit, a gray level processing unit, and other imaging processing sub-systems known in the art. The image processing unit 54 can store bitmap information for subsequent images or can operate in a real time mode.

The machine 10 includes a photoconductive imaging member or photoconductive belt 12 which is typically multilayered and has a substrate, a conductive layer, an optional adhesive layer, an optional hole blocking layer, a charge generating layer, a charge transport layer, a photoconductive or image forming surface 13, and, in some embodiments, an anti-curl backing layer. As shown, belt 12 is movable in the direction of arrow 16. The moving belt 12 is first charged by a charging unit 17*a*. A raster output scanner (ROS) device 66*a*, controlled by image processing unit 54, then writes a first complementary color image bitmap information by selectively erasing charges on the charged belt 12. The ROS 66*a* writes the image information pixel by pixel in a line screen registration mode. It should be noted that either discharged area development (DAD) can be employed in which discharged portions are developed or charged area development (CAD) can be employed in which the charged portions are developed with toner.

Figure 2:
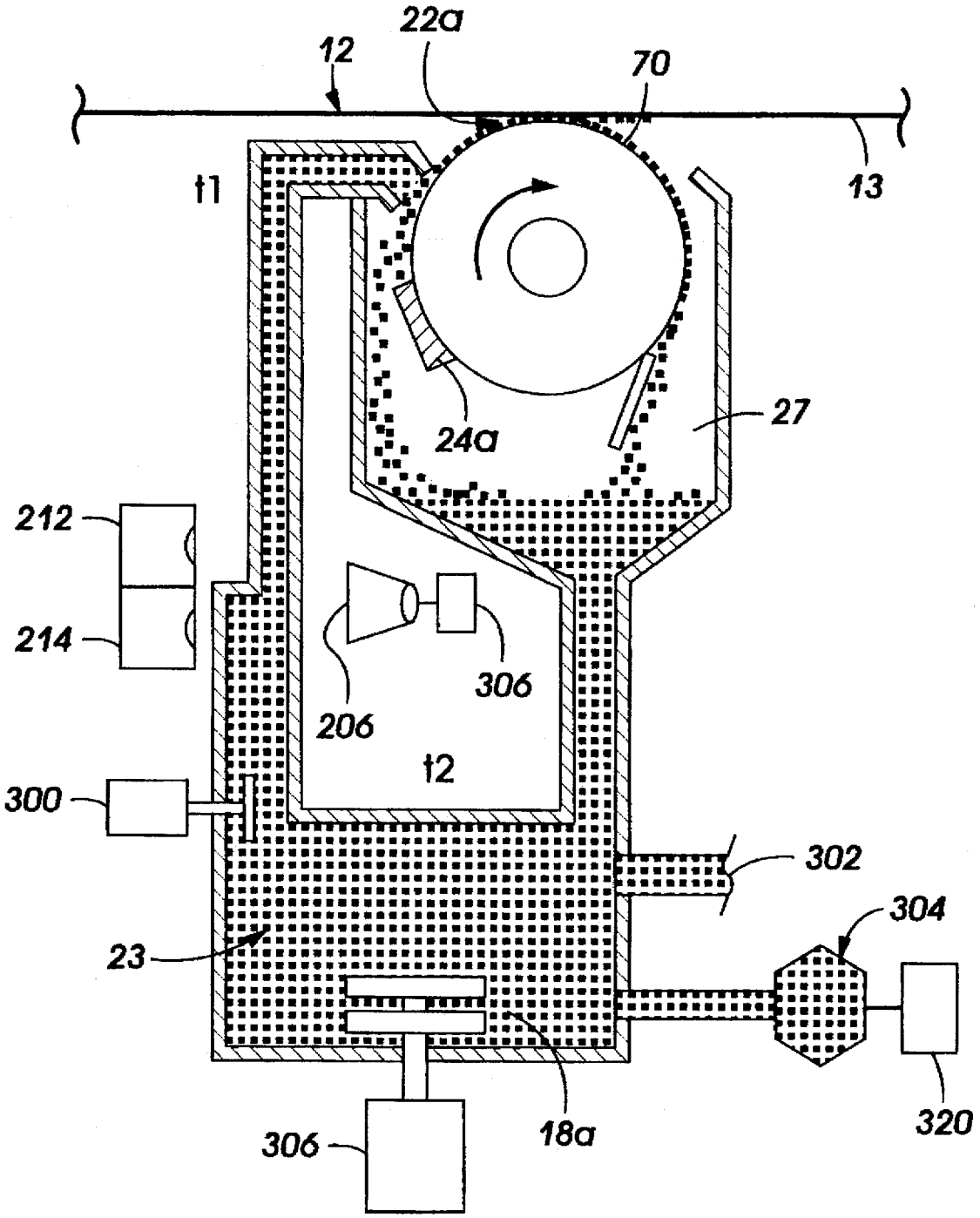
FIG. 2 is a vertical schematic of the development system of FIG. 1.

Referring now to FIGS. 1 and 2, after the electrostatic latent image has been recorded thus, belt 12 advances the electrostatic latent image to a first development station 20*a* in accordance with the present invention. Like subsequent development stations 20*b*, 20*c*, and 20*d*, the development station 20*a* includes a housing 21 defining a mixing chamber 23, a developer material delivery conduit 25, a development roller 70, and a spent developer material recovery chamber 27. The development roller 70, rotating in the direction as shown, advances a quantity of liquid developer material 18*a*, preferably black toner developer material containing charged black toner particles at a desired concentration, delivered to the roller 70 via the conduit 25, into a development zone or nip 22*a*. An electrode 24*a* positioned before the entrance to development zone or nip 22*a* is electrically biased to generate an AC field just prior to the entrance to development zone or nip 22*a* so as to disperse the toner particles substantially uniformly throughout the liquid carrier. The toner particles, disseminated at the desired concentration through the liquid carrier, pass by electrophoresis to the electrostatic latent image forming a first liquid color separation developed image. As is well known, the charge of the toner particles is opposite in polarity to the charge on the photoconductive or image forming surface 13.

After the first liquid color separation image is developed, for example, with black liquid toner, it is conditioned by a conditioning porous roller 26*a*, which is the same as subsequent identical rollers 26*b*, 26*c*, 26*d*, having perforations through the roller skin covering. Roller 26*a* contacts the developed image on belt 12 and conditions the image by compacting the toner particles of the image and reducing thefluid content thereof (thus increasing the percent solids) while inhibiting the departure of toner particles from the image. Preferably, the percent solids in the developed image is increased to more than 20 percent by weight. A pressure roller (not shown), mounted in pressure contact against the blotter roller 26*a*, may be used in conjunction with or in the place of a vacuum device (not shown), to squeeze the absorbed liquid carrier from the blotter roller for deposit into a receptacle.

In operation, roller 26*a*, 26*b*, 26*c*, 26*d* rotates in direction as shown to impose against the "wet" image on belt 12. The porous body of roller 26a, 26b, 26c, 26d absorbs excess liquid from the surface of the image through the skin covering pores and perforations. Vacuum device 28 located on one end of a central cavity of the roller 26a, 26b, 26c, 26d, draws liquid that has permeated into the roller, out through the cavity. Vacuum device 28 deposits the liquid in a receptacle or some other location for either disposal or recirculation as liquid carrier. Porous roller 26a, 26b, 26c, 26d then, continues to rotate in the direction as shown to provide a continuous absorption of liquid from the image on belt 12. The image on belt 12 advances to lamp 76a where residual charge left on the photoconductive surface 13 is erased by flooding the photoconductive surface with light from lamp 76a.

As shown, according to the REaD process of the machine 10, the developed latent image on belt 12 is subsequently recharged with charging unit 17b, and is next re-exposed by ROS 66b. ROS 66b superimposing a second color image bitmap information over the previous developed latent image. Preferably, for each subsequent exposure an adaptive exposure processor is employed that modulates the exposure level of the raster output scanner (ROS) for a given pixel as a function of toner previously developed at the pixel site, thereby allowing toner layers to be made independent of each other. Also, during subsequent exposure, the image is re-exposed in a line screen registration oriented along the process or slow scan direction. This orientation reduces motion quality errors and allows the utilization of near perfect transverse registration. At the second development station 20b in accordance with the present invention, a development roller 70, rotating in the direction as shown, advances a liquid developer material 18b, containing toner particles at a desired toner concentration, from the delivery conduit 25, to a second development zone or nip 22b. An electrode 24b positioned before the entrance to development zone or nip 22b is electrically biased to generate an AC field just prior to the entrance to development zone or nip 22b so as to disperse the toner particles substantially uniformly throughout the liquid carrier. The toner particles, disseminated through the liquid carrier, pass by electrophoresis to the previous developed image. The charge of the toner particles is opposite in polarity to the charge on the previous developed image.

A second conditioning roller 26b contacts the developed image on belt 12 and conditions the image by compacting the toner particles of the image and reducing fluid content while inhibiting the departure of toner particles from the image. Preferably, the percent solids is more than 20 percent, however, the percent of solids can range between 15 percent and 40 percent. The images on belt 12 advances to lamp 76b where any residual charge left on the photoconductive surface is erased by flooding the photoconductive surface with light from lamp 76.

To similarly produce the third image using the third toner color, for example magenta color toner, the developed images on moving belt 12 are recharged with charging unit 17c, and re-exposed by a ROS 66c, which superimposes a third color image bitmap information over the previous developed latent image. At the third development station 20c in accordance with the present invention, a development roller 70, rotating in the direction as shown, advances a magenta liquid developer material 18c, containing toner particles at a desired toner concentration, from the delivery conduit 25, to a third development zone or nip 22c. An electrode 24c positioned before the entrance to development zone or nip 22c is electrically biased to generate an AC field just prior to the entrance to development zone or nip 22c so as to disperse the toner particles substantially uniformly throughout the liquid carrier. The toner particles, disseminated through the liquid carrier, pass by electrophoresis to the previous developed image. A conditioning roller 26c contacts the developed images on belt 12 and conditions the images by reducing fluid content so that the images have a percent solids within a range between 15 percent and 40 percent. The images or composite image on belt 12 advances to lamp 76c where any residual charge left on the photoconductive surface of belt 12 is erased by flooding the photoconductive surface with light from the lamp.

Finally, to similarly produce the fourth image using the fourth toner color, for example cyan color toner, the developed images on moving belt 12 are recharged with charging unit 17d, and re-exposed by a ROS 66d. ROS 66d superimposes a fourth color image bitmap information over the previous developed latent images. At the fourth development station 20d in accordance with the present invention, development roller 70, rotating in the direction as shown, advances a cyan liquid developer material 18d, containing toner particles at a desired toner concentration, from the delivery conduit 25, to a fourth development zone or nip 22d. An electrode 24d positioned before the entrance to development zone or nip 22d is electrically biased to generate an AC field just prior to the entrance to development zone or nip 22d so as to disperse the toner particles substantially uniformly throughout the liquid carrier. The toner particles, disseminated through the liquid carrier, pass by electrophoresis to the previous developed image. A conditioning roller 26d contacts the developed images on belt 12 and conditions the images by reducing fluid content so that the images have a percent solids within a range between 15 percent and 40 percent. It should be evident to one skilled in the art that the color of toner at each development station could be in a different arrangement.

The resultant composite multicolor image, a multi layer image by virtue of different color toner development by the developing stations 20a, 20b, 20c and 20d, respectively having black, yellow, magenta, and cyan, toners, is then advanced to an intermediate transfer station 78. At the transfer station 78, the multicolor image is electrostatically transferred to an intermediate member 80 with the aid of a charging device 82. Intermediate member 80 may be either a rigid roll or an endless belt, as shown, having a path defined by a plurality of rollers in contact with the inner surface thereof. The multicolor image on the intermediate transfer member 80 is conditioned again for example by a blotter roller 84 which further reduces the fluid content of the transferred image by compacting the toner particles thereof while inhibiting the departure of the toner particles. Blotter roller 84 is adapted to condition the image so that it has a toner composition of more than 50 percent solids.

Subsequently, the reconditioned image on the surface of the intermediate member 80 is advanced through a liquefaction stage before being transferred within a second transfer nip 90 to an image recording sheet 44. Within the liquefaction stage, particles of toner forming the transferred image are transformed by a heat source 89 into a tackified or molten state. The heat source 89 can also be applied to member 80 internally. The intermediate member 80 then continues to advance in the direction of arrow 92 until the tackified toner particles reach the transfer nip 90.

The transfer nip 90 is more specifically a transfixing nip, where the multicolor image is not only transferred to the recording sheet 44, but it is also fused or fixed by the application of appropriate heat and pressure. At transfix nip 90, the liquefied toner particles are forced, by a normal force applied through a backup pressure roll 94, into contact with the surface of recording sheet 44. Moreover, recording sheet 44 may have a previously transferred toner image present on a surface thereof as the result of a prior imaging operation, i.e. duplexing. The normal force, produces a nip pressure which is preferably about 20 psi, and may also be applied to the recording sheet via a resilient blade or similar spring-like member uniformly biased against the outer surface of the intermediate member across its width.

As the recording sheet 44 passes through the transfix nip 90 the tackified toner particles wet the surface of the recording sheet, and due to greater attractive forces between the paper and the tackified particles, as compared to the attraction between the tackified particles and a liquid-phobic surface of member 80, the tackified particles are completely transferred to the recording sheet. As shown, the surface of the intermediate transfer belt 80 is thereafter cleaned by a cleaning device 98 prior to receiving another toner image from the belt 12.

Invariably, after the multicolor image was transferred from the belt 12 to intermediate member 80, residual liquid developer material remained adhering to the photoconductive surface of belt 12. A cleaning device 51 including a roller formed of any appropriate synthetic resin, is therefore provided as shown and driven in a direction opposite to the direction of movement of belt 12 to scrub the photoconductive surface clean. It is understood, however, that a number of photoconductor cleaning means exist in the art, any of which would be suitable for use with the present invention. Any residual charge left on the photoconductive surface after such cleaning is erased by flooding the photoconductive surface with light from a lamp **76*d* prior to again charging the belt 12** for producing another multicolor image as above.

As illustrated the reproduction machine 10 further includes an electronic control subsystem (ESS) shown as 148 for controlling various components and operating subsystems of the reproduction machine. ESS 148 thus may be a self-contained, dedicated minicomputer, and may include at least one, and may be several programmable microprocessors for handling all the control data including control signals from control sensors for the various controllable aspects of the machine.

Referring now to FIGS. 1 to 6, the LID reproduction machine 10 importantly includes at each development station **20*a*, 20*b*, 20*c*, and 20*d*, a filming attenuation correcting toner concentration sensor assembly 200 in accordance with the present invention. As shown in FIG. 2, each development station 20*a*, 20*b*, 20*c*, and 20*d*, includes a housing 21 defining a liquid developer material mixing sump 23 containing liquid developer material 18*a*, 18*b*, 18*c*, 18*d*; a conduit member 25 for carrying liquid developer material to the development zone 22*a*, 22*b*, 22*c*, 22*d*; and a depleted or excess liquid developer recovery tank 27 that is connected back to the mixing sump 23. Means such as a pump 300 are provided for moving mixed developer material from the sump 23 through the conduit 25, to the development zone 22*a*. Fresh or replenishment liquid developer material is supplied to the mixing sump 23 through a supply source 302, and toner concentrate is controllably supplied from a source 304 for adjusting and controlling the toner concentration of the liquid developer material being mixed in the mixing sump 23. A mixing device 306 mixes liquid developer material within the mixing sump 23**.

Figure 3:
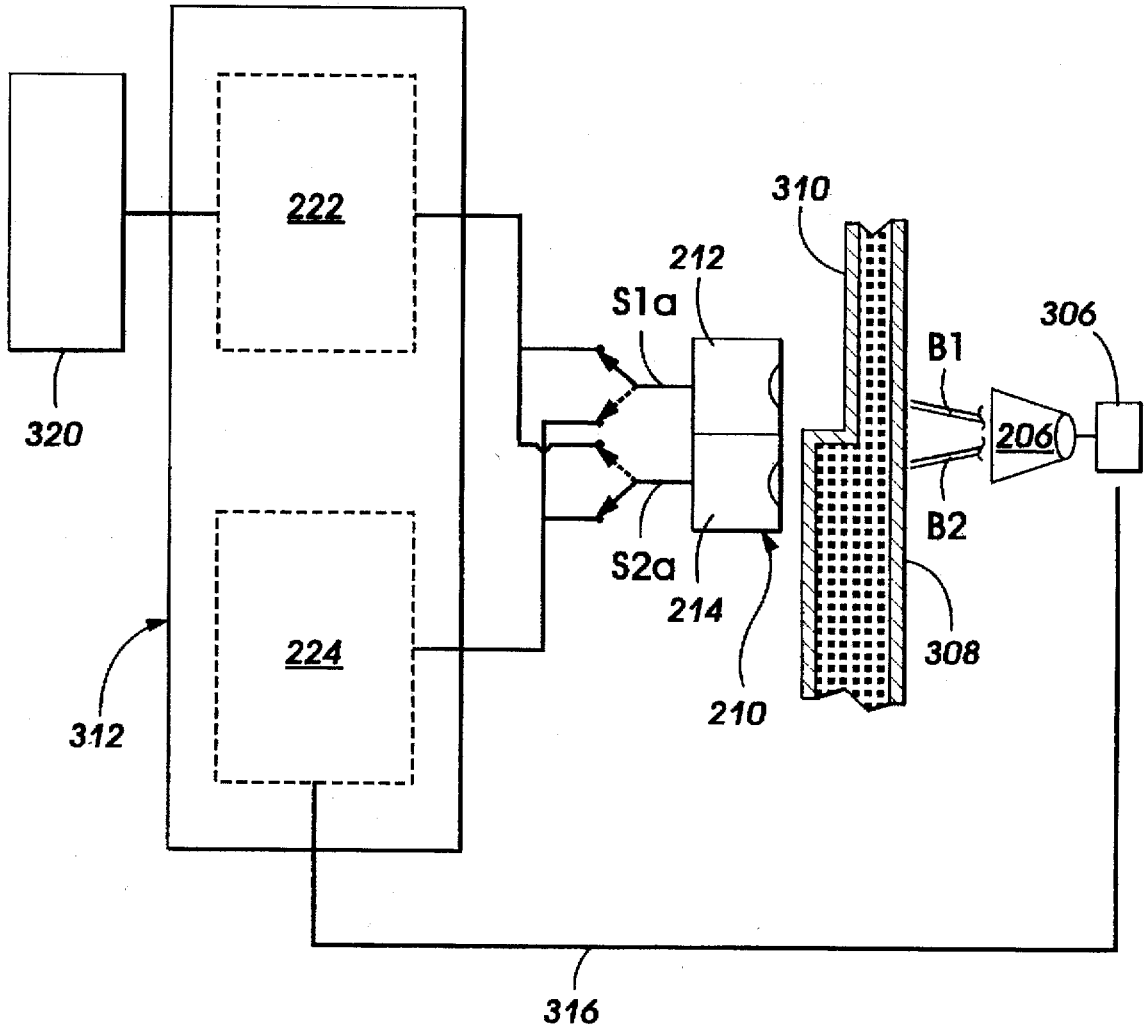
FIG. 3 is an enlarged schematic of the filming attenuation correcting toner concentration sensor assembly of FIGS. 1 and 2.

As further illustrated, the filming attenuation correcting toner concentration sensor assembly 200 includes a fast container or conduit portion 202, and a second container or conduit portion 204 that is immediately adjacent the first portion 202. As shown, container or conduit portions 202, 204 are adjoining portions of the liquid developer material carrying conduit 25, and are suitable for containing mixed liquid developer material **18*a*, 18*b*, 18*c*, 18*d* FIG. 1. In addition, portions 202, 204 are ordinarily transparent or translucent and suitable for transmitting normalized light without significant attenuation. As shown in FIGS. 1, 2 and 3, each of the container or conduit portions 202 and 204 of each development system, is filled with mixed liquid developer material 18*a*, 18*b*, 18*c*, 18*d*** that can absorb light passing through it, and whose toner concentration is being measured and controlled.

Importantly, in accordance with the present invention, a thickness "L1" of the first portion 202 is made significantly less or smaller than a thickness L2 of the second portion 204. Accordingly, for any column or volume of a given base area across these portions, there is more of the developer material contained in the column through the second portion 204, than there is in a similar base area column through the first portion 202. A light beam having a constant intensity ICI that is focused longitudinally through each column, will therefore undergo greater absorption or greater attenuation through the second, longer, column in the second portion 204.

As is well known, Bouguer's law and Beer's law are two fundamental laws of light absorption by a homogeneous, transparent system such as the (clear carrier liquid and toner particle mixture), developer material in the translucent conduit portions 202, 204 above. Bouguer's law expresses a relationship between the light absorptive capacity and a layered thickness of the absorbing system or material. According to Bonguer's law each layer of equal thickness absorbs an equal fraction of a light traversing it. Thus a beam of light of a given intensity upon passing through an absorbing system of a given thickness, will decrease in intensity as a function of the given thickness. The second law formulated by Beer, expresses a relationship between the light absorptive capacity and the concentration of an absorbing substance in solution forming the thickness. Thus, the fraction of a light beam absorbed on passing through a solution containing an absorbing substance having a thickness L is directly proportional to the concentration "C" of the absorbing substance in the solution.

Mathematically, Beer's law is expressed as:

$$T=ke^{-BCL},$$

where T is the corrected or normalized transmittance;

B is the absorption coefficient of the absorbing system;

C is the concentration thereof;

L is the thickness; and k is a transmissibility constant for the system.

Ordinarily, the transmittance T of a system is a ratio Io/Ii, where Io is the output intensity of light transmitted through and being emitted from the system over the incident intensity, and Ii is the intensity of the incident light to be transmitted.

Figure 5:
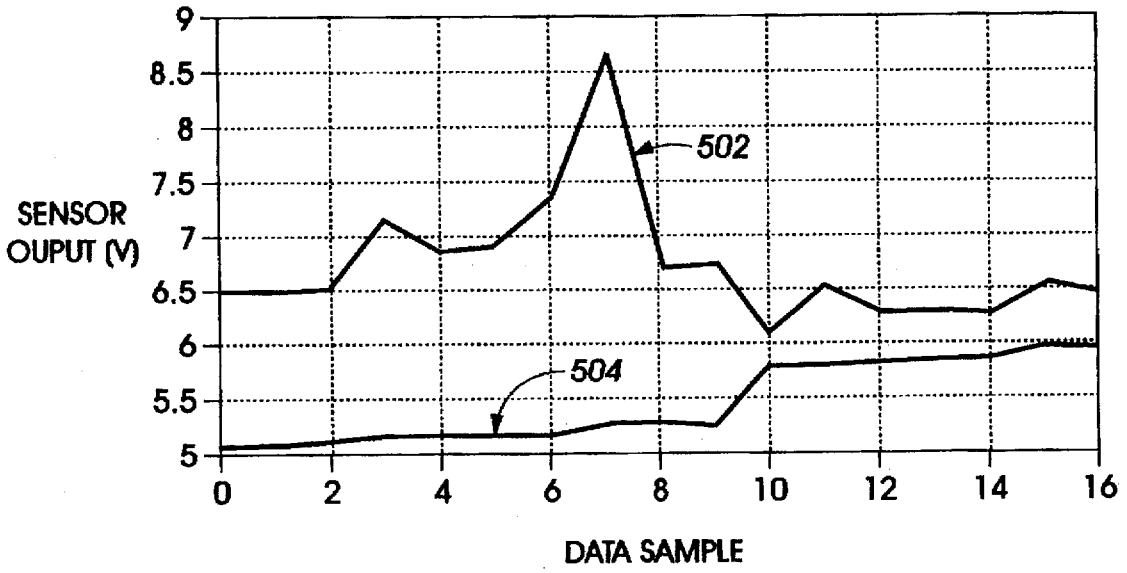
FIG. 5 is a comparative plot of TC control outputs on the basis of various sample data over time from a conventional single optical path and from a dual optical path sensor assembly in accordance with the present invention.
Figure 6:
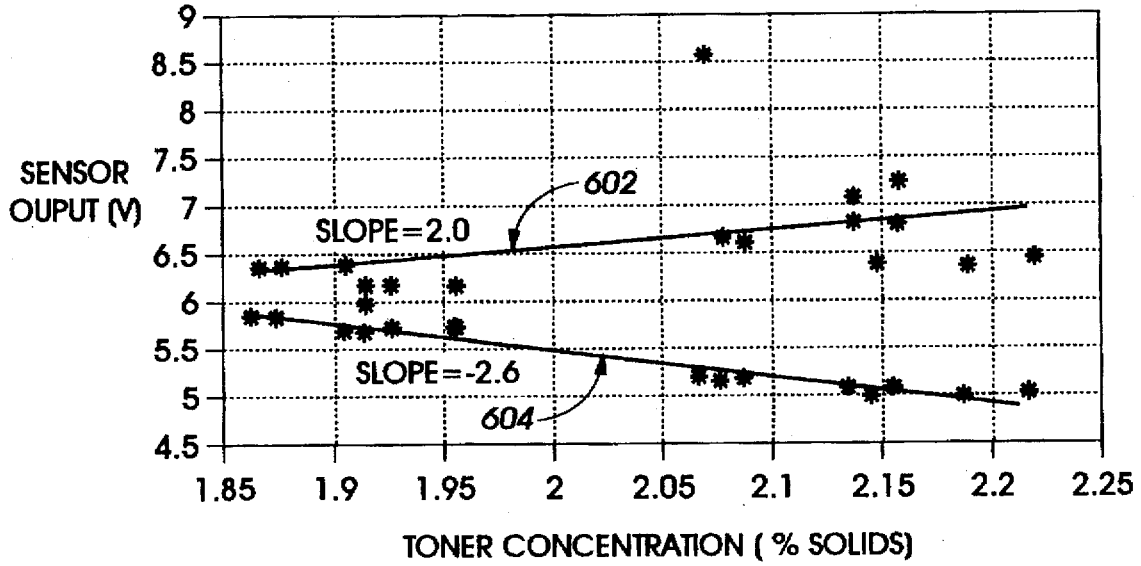
FIG. 6 is a comparative plot of TC control outputs over different levels of TC from a conventional single optical path and from a dual optical path sensor assembly in accordance with the present invention.

Conventional single optical path sensors (applying Bouguer's and Beer's laws) typically generate an output signal that is directly proportional to the transmittance or light transmitted. Typically, such an output signal is then controlled, and any changes in the signal being controlled are assumed to be a function of only changes in the concentration C (also equal TC in the description elsewhere) of the absorbing system. Unfortunately, however, as pointed out above, such a change in the signal may be due, in part, to changes in light source intensity, to changes in the filming of optical surfaces of the sensor assembly or, in part, to changes in toner concentration. As illustrated, for example, in FIGS. 5 and 6, plots 502, 602, attempting to conventionally controll the output signal as being due only to changes in toner concentration produces erratic and imprecise results as verified by the wide dispersion of points through these plots 502, 602.

In accordance with the present invention, however, such erratic and imprecise results ate avoided by using the dual optical path filming attenuation correcting toner concentration sensor assembly 200 and method.

As shown in FIGS. 1–3, the sensor assembly 200 (in addition to the container or conduit portions 202, 204 of different thicknesses) also includes a single common light source 206 having an initially desired intensity IC1, and a controller 306 for controlling such intensity. The light source 206 is positioned on a first side 308 of the first and second container or conduit portions 202, 204. Light from the source 206 is importantly split optically into two beams B1, B2 that are then focused, for example by means of fiber optic cables, onto, and for attenuated or absorptive transmission, through developer material in the first and second portions 202, 204 respectively. The absorbing system including the transparent or translucent container or conduit portions and the developer material contained therein obeys Bouguer's and Beer's law.

Referring now to FIGS. 2 and 3 in particular, the filming attenuation correcting toner concentration sensor assembly 200 further includes a dual path optical sensor 210, having particular electronic circuits 312. As shown, the dual optical path sensor 210 is positioned on a second side 310 of the fast and second portions 202, 204, for receiving and measuring attenuated light transmitted from the focused beams B1, B2 respectively. Accordingly, the dual optical path sensor 210 includes a first photodiode 212, and a second photodiode 214 that are aligned so as to receive and measure the attenuated light transmitted from the focused beams B1, B2 respectively. The particular electronic circuits 312 as illustrated in FIG. 3, for example, include signal processing circuits 222, and 224.

Additionally, the sensor assembly 200 includes the light source intensity control feedback circuit 306, and a toner concentrate dispensing control circuit 320. Output signals S1*a* and S2*a*, which are each proportional to a transmittance from the attenuated light beams B1, B2, respectively, are produced respectively by the photodiodes 212, 214 for processing and use by the particular electronic circuits, in accordance with the present invention.

Figure 4:
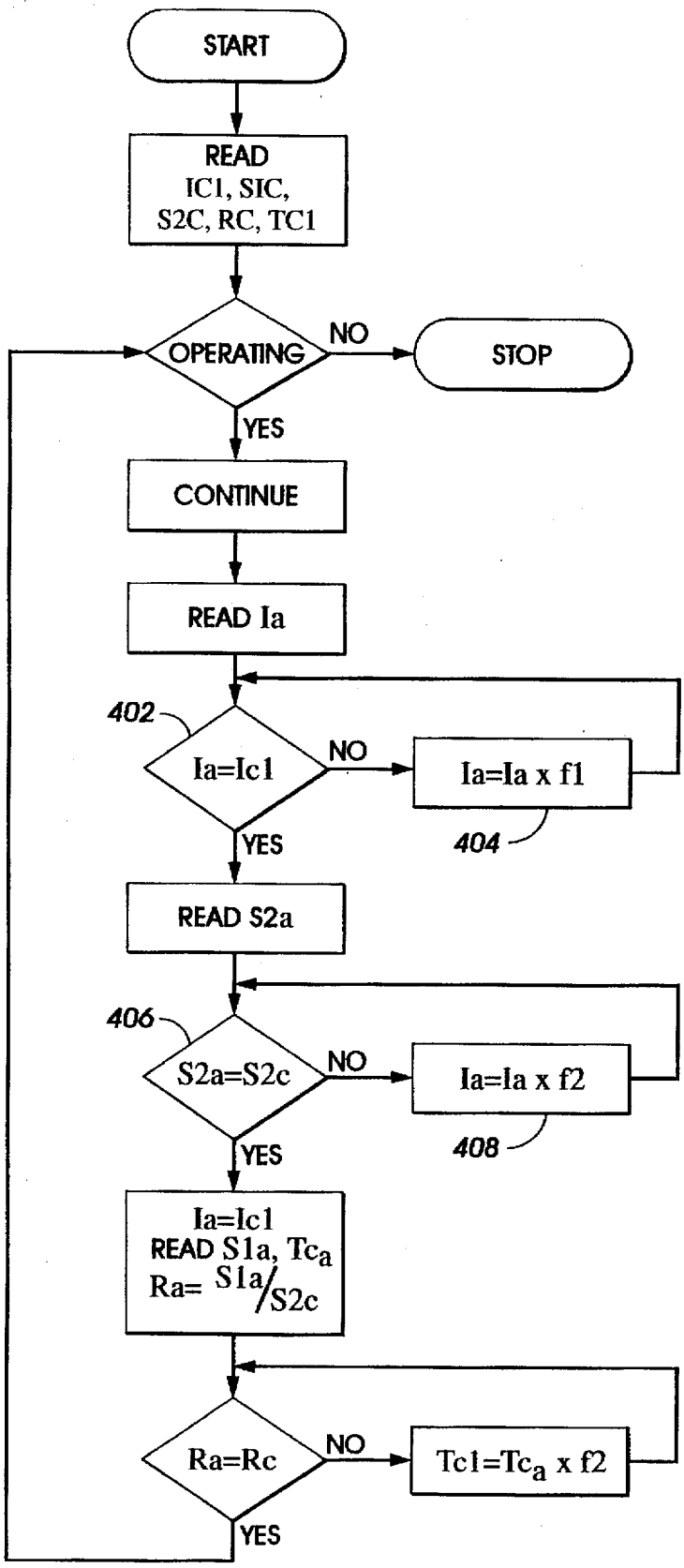
FIG. 4 is an illustrative flow chart for the present invention.

Referring now to FIGS. 2, 3, and 4, the method of the present invention is illustrated wherein IC1 is the desired, and Ia is the actual, intensity of the single light source; S1*c* is the desired, and S1*a* is the actual, transmittance proportional output signal from the fast photodiode 212; S2*c* is the desired, and S2*a* is the actual, transmittance proportional output signal from the second photodiode 214; RC is the desired filming-effect free ratio equal to S1*c* divided by S2*c*, and Ra is the actual ratio equal to S1*a* divided by S2*c*; TCI is the desired, and TCa is the actual concentration of toner in the mixed developer material; f1 is a factor for maintaining Ia equal to IC1 ; f2 is a factor for adjusting IC1 to a new level at which S2*a* equals S2*c*; and f3 is a factor for adjusting an amount of concentrated toner particles added to liquid developer material being mixed so that S1*a* is such that the actual ratio Ra (=S1*a*/S2*c*) is equal to RC.

The illustrated method includes a step where the intensity control circuit 306 is programmed at a first level (boxes 402, 404, FIG. 4) to use a factor f1 to maintain the intensity of the light source at a desired and initial value IC1. In order to compensate, correct or neutralize the effect of filming of optical surfaces, the intensity control circuit 306 is connected at another level to the signal processing circuit (boxes 406, 408, FIG. 4) for adjusting the intensity from IC1=Ia, by a second factor f2, to a different value of intensity so that a resulting actual output signal S2*a* from the second photodiode 214 is equal to S2*c* which is constant at the desired level. For example, as preferred in accordance with the present invention, the actual output signal S2*a* is compared to and controlled to be constant and equal to the initial output signal S2*c*. A resulting intensity correction control signal 316 when generated, is then fed back to the intensity control circuit 306, for adjusting by the factor f2, from Ia=IC1, to Ia=Ia(f2), such that S2*a* is made equal to S2*c*.

After such light source intensity correction, the attenuated light proportional output signal S1*a* from the first photodiode 212 is then read and processed, preferably dividing it by S2*a* (=S2*c*) to create the ratio Ra. The ratio Ra is then processed with respect to the ratio Rc, and the result is fed through to the toner concentrate dispensing control circuit 320, for purposes of controlling an amount of toner concentrate from source 232, that is added to the mixing chamber 23 in order to change the TC of the developer material 18*a*, 18*b*, 18*c*, or 18*d*.

According to the method (FIG. 4), initially the desired TC, light source intensity IC1, transmittance-proportional first and second output signals S1*c*, S2*c* from the first and the second photodiodes 212, 214, of the assembly respectively, and the desired control ratio RC, are established and read. The desired intensity of the light source is then ordinarily maintained at the desired level IC1. Next however, such a desired intensity level is adjustable according to the present invention in order to maintain the second transmittance-proportional output signal S2*c* at a constant value.

Following any such S2*c*-related adjustment in the intensity level of the light source, values for an actual first transmittance-proportional output signal S1*a* and for the constant second transmittance-proportional output signal S2*c* are read, and an actual control ratio (Ra) is calculated as S1*a*/S2*c*. This actual control ratio Ra is then compared to the desired control ratio RC, and any difference between RC and Ra is treated as a difference between the desired toner concentration TC1 when the control ratio is equal to RC, and an actual toner concentration TCa when the control ratio is equal to Ra. The toner concentration of the liquid developer material is then adjusted up or down from TCa, until S1*a* is such that the ratio Ra or (S1*a*/S2*c*) is equal to RC thus resulting in the desired toner concentration of TC1.

In controlling the toner concentration of a liquid developer material with a dual optical path sensor assembly in the above manner, it has been found, as illustrated by the plots 504, and 604 of FIGS. 5 and 6 respectively, that TC control results are not dispersed widely, and do not tend to drift (as much as do similar single path sensor control results see plots 502, 602 (FIGS. 5 and 6) over time, or over different values of concentration.

The filming independence of the ratios RC, Ra can be verified from Beer's law, as follows, where as above Beer's law is expressed as:

$$T=ke^{-BCL},$$

with T being the corrected or normalized transmittance;

B being the absorption coefficient of the absorbing system;

C being the concentration thereof;

L being the thickness; and k being a transmissibility constant for the system.

For the assembly of the present invention, B the absorption coefficient will be the same for the first and second optical paths as represented by the first and second photodiodes 212, 214; the thicknesses will be L1 and L2 respectively with a constant difference of L2–L1; the transmissibility constants (each including a filming effect factor) will be $K_1$ and $K_2$ which can be reasonably assumed to be equal by design; and the transmittances will be T1, T2 respectively. Thus;

$$T1=K_1e^{-BCL1};$$

$$T2=k_2e^{-BCL2}; \text{ and}$$

$$T1/T2=RC=(K_1e^{-BCL1})/(k_2e^{-BCL2}); \text{ therefore}$$

$$RC=e^{-BC(L2-L1)};$$

where $K_1$ and $K_2$ (which are equal as above), cancel out, thereby neutralizing or canceling out what would otherwise be filming dependent factors $K_1$ and $K_2$ if a transmittance T1, T2 or a transmittance-proportional signal S1*a*, S2*a* are used instead of a ratio thereof. Note that RC as such is derived from Beer's Law equations, and therefore is a function of toner concentration, and more importantly is dependent only on the toner concentration "C" or (TC elsewhere). This is because, the thickness difference L2–L1 is fixed, and is thus a constant, say KY. In other words;

$RC=e^{-BCkY}$; where KY is such a constant (L2–L1), and

Since B is also a constant, the only variable in the value of RC is C, the toner concentration. As such, changes in the ratio RC can clearly be said to depend only on changes in C.

Using changes in the ratio RC (which is calculated from Beer's Law) as a basis to control for changes in toner concentration C, clearly avoids or eliminates filming effects (reasonably assumed to be equal or common) from the control equation, and thus avoids filming induced instability from the control results of the sensor assembly of the present invention as illustrated by plots 504, 604, (FIGS. 5 and 6).

Referring now to FIGS. 5 and 6 in particular, plots 504, 604 of a dual path filming attenuation correcting sensor assembly of the present invention are shown, and are compared to plots 502, 602 of a conventional single optical path sensor assembly for the same samples. As can be noticed, the conventional plots 502, 602 include points that tend to be more erratic and widely dispersed, and that also indicate undesirable drift over time. On the other hand, plos 504, 604 show much reduced drift (such drift is usually due to filming) over time, and thus yield significantly improved accuracy as measured relative to a linear calibration of the curves.

To summarize, the dual optical path filming attenuation correcting toner concentration sensor assembly 200 and method in accordance with the present invention include one common light source 206 producing light. The produced light is optically split into two beams B1, B2 each of which is sent through a fixed, but different beam attenuating thickness L1, L2 of liquid developer material contained in two translucent conduits 202, 204, and having a desired toner concentration TC or C. The attenuated light from each beam B1, B2 is sensed by two separate identical photodiodes 212, 214, respectively. It should be noted that each thickness L1, L2 of the liquid developer material that the beams B1, B2 pass through obeys Beer's law. Thus, at a fixed thickness, changes in the transmittance or transmittance-proportional output signal for the attenuated light of each beam, will be proportional to changes in the toner concentration of the liquid developer material forming the beam attenuating thickness. Because of design and proximity of the conduits 202, 204, common or equal filming of the optical surfaces, particularly of the internal surfaces of the conduits of each thickness is reasonably assumed.

Importantly in accordance with the present invention, rather than using a measure of changes in a single transmittance value (or single transmittance-proportional signal value) that as argued above, is filming-factor/dependent, to control the TC, a filming-factor/independent control ratio (RC) of the two transmittance proportional values S1*a* and S2*c* is used. This is accomplished with the dual optical path filming attenuation correcting toner concentration sensor assembly 200 and method. By it, a transmittance or transmittance-proportional output signal S2*a* from the second path is maintained constant at a desired value S2*c* via feedback to the single illumination source. Maintaining S2*a* constant at S2*c* thus yields a simple, single, filming compensated output signal S1*a* that is then used as above, rather than requiring filming dependent calculations from S1*a* or S2*a*.

While the invention has been described with reference to particular preferred embodiments, the invention is not limited to the specific examples shown, and other embodiments and modifications can be made by those skilled in the art without depending from the spirit and scope of the invention and claims.

What is claimed is:

1. A method of controlling a concentration of a mixture in a container, including a light absorbing substance and a clear liquid carrier in solution, while correcting the effects of container filming, the method comprising the steps of:

(a) splitting light from a single light source having a controllable intensity, into a first light beam and a separate second light beam;

(b) focusing the first light beam through a first quantity of the mixture contained in a first light transmitting container made of a first material and having a first thickness, and focusing the second light beam through a second quantity of the mixture contained in a second light transmitting container made of the first material and having a second thickness greater than the first thickness;

(c) generating a first proportional output signal by sensing with a first photodiode, a fast attenuated light transmitted from the first light beam through the first light transmitting container and through the first quantity of the mixture;

(d) generating a second proportional output signal by sensing with a second photodiode, a second attenuated light transmitted from the second light beam through the second light transmitting container and through the second quantity of the mixture;

(e) maintaining the second proportional output signal at a constant level by adjusting the controllable intensity of the single light source; and (f) adjusting the concentration of the light absorbing substance in the mixture such that a filming-independent ratio equal to the first proportional output signal divided by the second proportional output signal, is also maintained at a constant.

2. A liquid immersion development (LID) reproduction machine comprising:

(a) a movable image bearing member;

(b) latent image forming apparatus for forming a latent image electrostatically on said image bearing member; and (c) a development system containing liquid developer material including a clear liquid carrier and toner particles having a desired concentration therein, said development system including:

(i) a housing defining a developer mixing chamber and a light transmitting conduit for carrying mixed liquid developer material to a development zone, said mixed liquid developer material carrying conduit including a first portion having a first thickness, and a second portion adjacent said first portion, said second portion having a second thickness significantly greater than said fast thickness of said first portion;

(ii) a source of concentrated toner particles connected to said mixing chamber for controllably supplying a determined amount of concentrated toner particles into said mixing chamber to adjust the desired concentration of toner particles in the mixed developer;

(iii) a single light source assembly producing a light having a controllable intensity, said single light source assembly including means for splitting said light into a first light beam and a second light beam, and said light source being positioned on a fast side of said light transmitting conduit such that said fast light beam is incident onto said first portion of said conduit, and said second light beam is incident onto said second portion of said conduit;

(iv) a dual optical path sensor including a first photodiode and a second photodiode, said dual optical path sensor being positioned on a second and opposite side of said light transmitting conduit such that said first photodiode receives light transmitted from said first beam of light and produces a first proportional output signal, and such that said second photodiode receives light transmitted from said second beam of light and produces a second proportional output signal;

(v) first control means for adjusting and maintaining said second proportional output signal at a constant level by adjusting said controllable intensity of said single light source; and (vi) second control means for adjusting and maintaining at a constant level, a filming-effect independent ratio equal to said first proportional output signal divided by said second proportional output signal, said filming-effect independent ratio being maintained constant by adjusting an amount of concentrated toner particles being added to said mixing chamber, said concentrated toner particles being added such that an actual first proportional output signal obtained at which said filming-effect independent ratio is at the constant level, thereby resulting in a toner concentration of the mixed liquid developer material that is at a desired level without undesirable effects of filming of optical surfaces.

3. The LID reproduction machine of claim 2 including a plurality of said development system.

4. The LID reproduction machine of claim 2, wherein each of said first portion and said second portion of said light transmitting conduit containing the mixed liquid developer material obeys Beer's law.

5. A filming attenuation correcting concentration sensor assembly comprising:

(a) a filmable light transmitting solution conduit including a first portion having a first cross-sectional dimension, and a second portion having a second cross-sectional dimension significantly greater than said first cross-sectional dimension, each said first and said second cross-sectional dimensions containing a solution consisting essentially of a clear liquid carrier and a light absorbing substance having a desired concentration;

(b) a single light source assembly producing a light having a controllable intensity, said single light source assembly including means for splitting said light into a first light beam and a second light beam, and said light source being positioned on a first side of said light transmitting conduit such that said first light beam is incident onto said first portion of said conduit, and said second light beam is incident onto said second portion of said conduit;

(c) a dual optical path sensor including a first photodiode and a second photodiode, said dual optical path sensor being positioned on a second and opposite side of said light transmitting conduit such that said first photodiode receives light transmitted from said first beam of light and produces a first proportional output signal, and such that said second photodiode receives light transmitted from said second beam of light and produces a second proportional output signal;

(d) first control means for adjusting and maintaining said second proportional output signal at a constant level by adjusting said controllable intensity of said single light source; and (e) second control means for adjusting and maintaining at a constant level, a filming-effect independent ratio equal to said first proportional output signal divided by said second proportional output signal, said filming-effect independent ratio being maintained constant by adjusting an mount of concentrated toner particles being added to said mixing chamber, said concentrated toner particles being added such that an actual first proportional output signal obtained at which said filming-effect independent ratio is at the constant level, thereby resulting in a toner concentration of the mixed liquid developer material that is at a desired level without undesirable effects of filming of optical surfaces.

* * * * *